US006659725B2

(12) United States Patent
Yeo et al.

(10) Patent No.: US 6,659,725 B2
(45) Date of Patent: Dec. 9, 2003

(54) VIBRATION DAMPING

(75) Inventors: Stuart Yeo, Stretton (GB); Peter J Goodman, Bristol (GB)

(73) Assignee: Rolls-Royce plc, London (GB)

( * ) Notice: Subject to any disclaimer, the term of this patent is extended or adjusted under 35 U.S.C. 154(b) by 48 days.

(21) Appl. No.: 10/107,153

(22) Filed: Mar. 28, 2002

(65) Prior Publication Data

US 2002/0146322 A1 Oct. 10, 2002

(30) Foreign Application Priority Data

Apr. 10, 2001 (GB) ..... 0109033

(51) Int. Cl.[7] ..... F01D 21/06
(52) U.S. Cl. ..... 416/190; 416/500
(58) Field of Search ..... 416/500, 190

(56) References Cited

U.S. PATENT DOCUMENTS

| | | | | | |
|---|---|---|---|---|---|
| 1,554,614 | A | * | 9/1925 | Allen | 416/193 A |
| 3,897,171 | A | * | 7/1975 | Stahl | 416/244 R |
| 5,156,528 | A | * | 10/1992 | Bobo | 416/190 |
| 5,478,207 | A | | 12/1995 | Stec | |

FOREIGN PATENT DOCUMENTS

| | | | |
|---|---|---|---|
| GB | 1 410 607 | SP | 10/1975 |
| GB | 1 457 417 | SP | 12/1976 |
| GB | 1 518 076 | SP | 7/1978 |
| GB | 2 049 068 | A | 12/1980 |
| GB | 2 208 529 | A | 4/1989 |

* cited by examiner

*Primary Examiner*—Edward K. Look
*Assistant Examiner*—Igor Kershteyn
(74) *Attorney, Agent, or Firm*—W. Warren Taltavull; Manelli, Denison & Selter PLLC

(57) ABSTRACT

A vibration damper 46 for a gas turbine engine has convergent friction surfaces 48*a* and 48*b* and is located radially inward of the platforms 20*a* and 20*b* of two adjacent turbine blades. The angle subtended by the friction surfaces 48*a* and 48*b* is smaller than that subtended by the angled faces 22*a* and 22*b* associated with the platforms 20*a* and 20*b*. The center of mass of the damper 46 lies in a plane bisecting the angle subtended by the friction surfaces 48*a* and 48*b*. In use the damper 46 is urged radially outwards by centrifugal force so that at least one of the friction surfaces 48*a* and 48*b* makes planar contact with at least one of the angled faces 22*a* and 22*b*. Vibrational energy is dissipated by the resultant sliding movement between the friction surfaces 48*a* and 48*b* and the angled faces 22*a* and 22*b*. A secondary vibration damping mechanism arises from the oscillation of the damper 46 between the platforms 20*a* and 20*b*.

6 Claims, 2 Drawing Sheets

PRIOR ART

VIBRATION DAMPING

This invention relates to vibration damping. More particularly, though not exclusively, it relates to the damping of vibrations in aerofoil blades for gas turbine engines.

Gas turbine engines commonly include an axial-flow turbine that comprises at least one annular array of radially extending aerofoil blades mounted on a common disc. Each aerofoil blade is provided with a circumferentially extending platform near to its radially inner end so that the platforms of adjacent blades cooperate to define the radially inner circumferential boundary of the gas flow path over the blades.

In operation, there is a tendency for the gas flows over the aerofoil blades to cause the blades to vibrate to such an extent that some degree of damping is required. A commonly used design of prior art damper is axially elongated and essentially wedge-shaped in cross section, with two friction surfaces at its radially outer end. These friction surfaces are angled at approximately 60° to the radial direction of the blades and subtend an angle of approximately 120°. The damper is located between two adjacent blades, radially inward of the blade platforms. The radially inner faces of the blade platforms are designed to subtend the same angle as that subtended by the damper friction surfaces. In operation, centrifugal forces tend to draw the damper radially outwards so that its friction surfaces are brought into planar contact with the angled faces on the radially inner surfaces of the platforms. Any vibration of the blades will result in relative movement between the platforms of adjacent blades, and hence in sliding movement between the blade platform faces and the damper friction surfaces. The work done in overcoming the frictional forces associated with this sliding movement dissipates the vibrational energy in the blades and reduces the vibration.

One drawback of this design of damper is that as the relative positions of adjacent blades change as a result of blade vibration, the angle subtended by the blade platform faces may no longer be the same as that subtended by the damper friction surfaces. The surfaces are then no longer in planar contact; the damper will tend to tilt or rock rather than sliding, and the damping effect is lost.

Various designs have been proposed to overcome this problem. EP 0509838 discloses a wedge-shaped damper having raised pads on the two friction surfaces of the damper. The raised pads are located so as to reduce tilting of the damper and keep the raised pads in planar contact with the platform faces. U.S. Pat. No. 5,478,207 discloses a damper which is generally wedge-shaped but which has an offset centre of mass, intended to improve the stability of the damper and to maintain planar contact between the damper friction surface and the blade platform face.

Although these designs of damper address the problem of loss of planar contact, they share a further drawback, in that they are not effective for all modes of vibration. The classical theories of bladed disc vibration identify three types of vibrational modes—blade flap modes, edgewise modes and torsional modes. In an idealized situation, a perfectly tuned bladed disc (i.e. one in which all the blades have the same natural frequency) with a synchronous excitation (e.g. from upstream vanes) would give rise to a single vibration mode with a defined inter-blade phase angle. The smaller the number of vanes, the lower would be this phase angle. In a real situation, however, the blades will not all have the same natural frequency, so the relative blade motions will be complex and will encompass different types of vibrational modes.

It is therefore an object of the present invention to provide an improved damper, which will provide more effective damping in all vibrational modes.

According to the invention there is provided a blade-to-blade vibration damper for a gas turbine engine, the damper including a first friction surface for contacting a first face associated with a turbine blade and a second friction surface for contacting a second face associated with an adjacent turbine blade, said first and second friction surfaces and said first and second faces being planar, said first friction surface and said second friction surface being convergent, the closest-spaced ends of said first friction surface and said second friction surface being spaced apart by a distance at least as great as the maximum circumferential gap between the radially outer ends of said first face and said second face, the angle subtended by said first friction surface and said second friction surface being smaller than the angle subtended by said first face and said second face; wherein the mass of the damper is disposed such that the centre of mass of said damper lies in a plane bisecting the angle subtended by said friction surfaces.

Preferably the damper is substantially wedge-shaped in cross section.

Preferably said closest-spaced ends of said first friction surface and said second friction surface are joined by a convex, curved surface.

Preferably the difference between the angle subtended by said first friction surface and said second friction surface and the angle subtended by said first face and said second face is approximately 10°. In a particular preferred embodiment of the invention the angle subtended by said first friction surface and said second friction surface is approximately 110°, and the angle subtended by said first face and said second face is approximately 120°.

An embodiment of the invention will now be described, for the purpose of illustration only, with reference to the accompanying drawings, in which.

Figure 1:
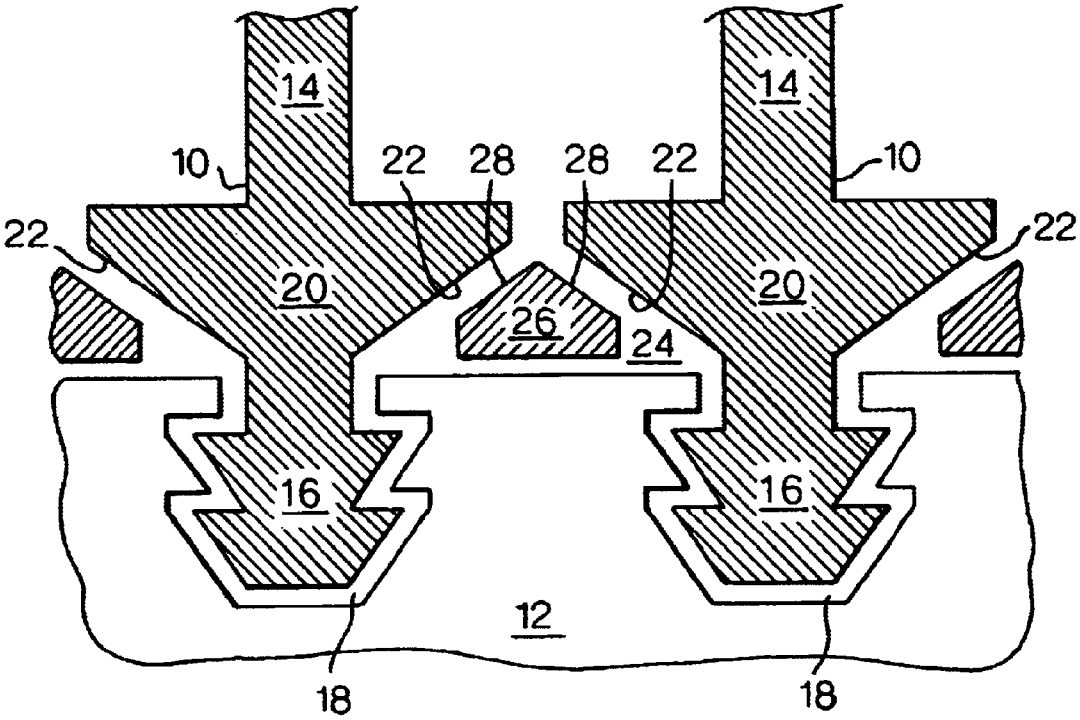
FIG. 1 is a schematic cross-sectional view showing two adjacent turbine blades mounted on a disc and provided with prior art friction dampers.

Referring first to FIG. 1, a turbine section of a gas turbine engine includes a plurality of turbine blades 10 mounted around the circumference of a rotatable disc 12. Each turbine blade 10 includes an aerofoil 14, which projects into a working fluid flowing axially through the turbine. The blades 10 are mounted on the disc 12 by means of dovetailed root portions 16 which fit into correspondingly shaped recesses 18 in the disc 12.

Located between the aerofoil 14 and root portion 16 of each blade 10 is a platform 20 having angled faces 22 on its radially inner side. The angled faces 22 of two adjacent blades 10 form an inverted V shape, which defines the radially outer boundary of the damper cavity 24. Each damper cavity 24 houses an axially elongated friction damper 26 of substantially wedge-shaped cross section having angled friction surfaces 28 of complementary shape to the inverted V made by the angled faces 22. The angle subtended by the friction surfaces 28 is designed to be the same as the angle subtended by the angled faces 22.

When the disc 12 and turbine blades 10 rotate, centrifugal forces urge the friction damper 26 radially outwards so that its friction surfaces 28 are forced into planar contact with the angled faces 22 of the platforms 20. If a blade 10 vibrates, this causes the friction surfaces 28 to slide against the angled faces 22, thus dissipating the vibrational energy and reducing the vibration.

Figure 2:
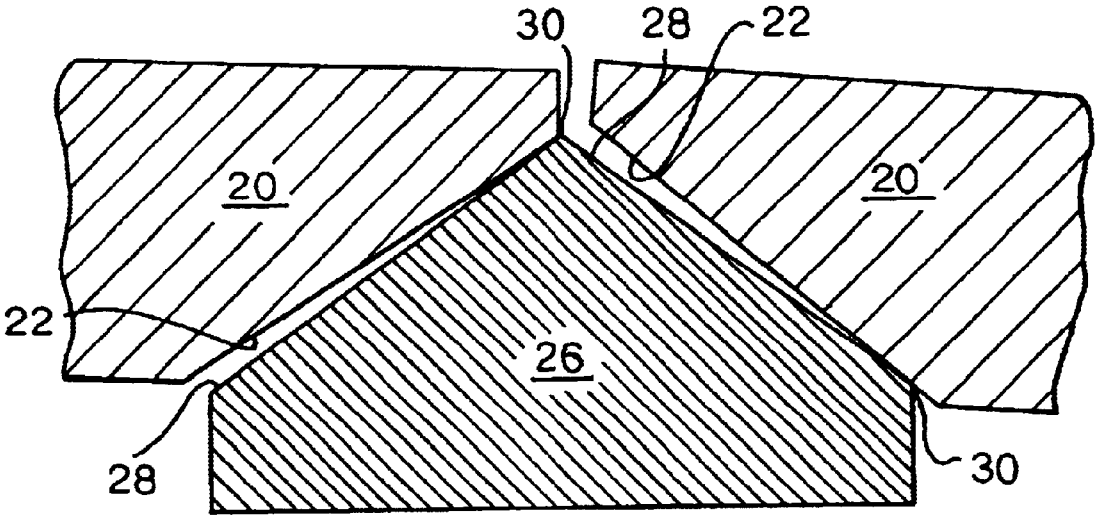
Fig.2. PRIOR ART
FIG. 2 is a schematic cross-sectional view of a prior art friction damper.

Referring now to FIG. 2, there is shown the situation which can arise under certain vibrational modes, where the positions of the turbine blades are such that the angle subtended by the angled faces 22 is no longer the same as the angle subtended by the friction surfaces 28. The friction damper 26 is in contact with the platforms 20 only along two lines 30 and it will be apparent that the planar contact necessary to allow sliding movement between the angled faces 22 and the friction surfaces 28 has been lost. The friction damper 26 will in fact tend to pivot about the two line contacts 30 and no effective damping will result.

Figure 3:
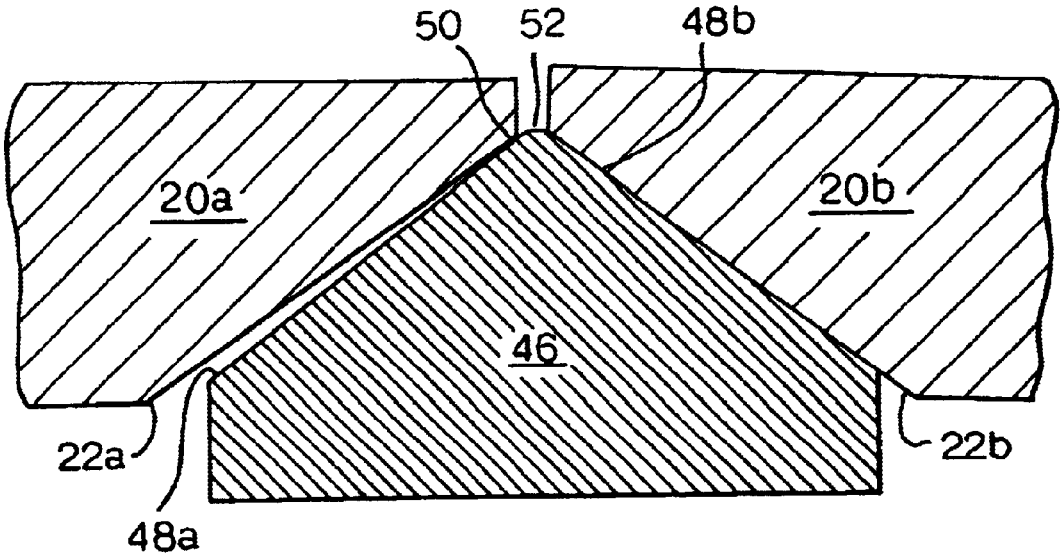
FIG. 3 is a schematic cross-sectional view of a friction damper according to the present invention.

Referring now to FIG. 3, there is shown an embodiment of a friction damper according to the present invention. The general arrangement of the turbine blade assembly is the same as in FIG. 1. In a particular preferred embodiment of the invention the angle subtended by the angled faces 22*a* and 22*b* on the radially inner side of the platforms 20*a* and 20*b* is approximately 120°. The damper 46 is axially elongated and substantially wedge-shaped in cross section, with convergent friction surfaces 48*a* and 48*b* on its radially outer side. The angle subtended by the friction surfaces 48*a* and 48*b* is smaller than the angle subtended by the angled faces 22*a* and 22*b*; in a particular preferred embodiment the angle subtended by the friction surfaces 48*a* and 48*b* is approximately 110°. It will be appreciated that alternative embodiments are possible, where different angles are subtended by the angled faces 22*a* and 22*b* or by the friction surfaces 48*a*and 48*b*, but in which the angle subtended by the friction surfaces 48*a* and 48*b* is still smaller than the angle subtended by the angled faces 22*a* and 22*b*.

The mass of the damper 46 is disposed such that its centre of mass lies in a plane bisecting the angle subtended by the friction surfaces 48*a* and 48*b*. It will be appreciated that, although in this embodiment of the invention the damper 46 is substantially wedge-shaped in cross section, other shapes or configurations of the damper 46 are possible in which its centre of mass lies in a plane bisecting the angle subtended by the friction surfaces 48*a* and 48*b*.

The closest-spaced ends of the friction surfaces 48*a* and 48*b* are spaced apart by a distance at least as great as the maximum circumferential gap between the radially outer ends of the angled faces 22*a* and 22*b*. This avoids the tendency for the damper 46 to "lock" between the platforms 20*a* and 20*b*. In a particular preferred embodiment of the invention the closest-spaced ends of the friction surfaces 48*a* and 48*b* are joined by a convex, curved surface 52. It will be appreciated, however, that alternative embodiments of the invention are possible in which the closest-spaced ends of the friction surfaces 48*a* and 48*b* are joined by a surface of a different shape, for example a flat surface.

Referring still to FIG. 3, it can be seen that the positions of the platforms 20*a* and 20*b* are similar to the positions of the platforms 20 in FIG. 2. Now, however, one friction surface 48*b* of the damper 46 is in planar contact with the angled face 22*b* of the platform 20*b* associated with one of the turbine blades, and there is additionally a line contact 50 between the damper 46 and the platform 20*a* associated with the adjacent turbine blade. This allows sliding movement to take place between the damper 46 and the blade platform 20*b*, damping the vibrations of the turbine blades.

The present invention also provides a second mechanism for damping vibration. The damper 46 is subject to a moment, brought about by the vibrations of the turbine blades. This moment fluctuates in response to the particular vibrational mode acting upon it. Because the centre of mass of the damper 46 lies in a plane bisecting the angle subtended by the friction surfaces 48*a* and 48*b*, this fluctuating moment will tend to cause the damper 46 to oscillate or vibrate within the damper cavity, bringing the friction surfaces 48*a* and 48*b* into contact alternately with the two angled faces 22*a* and 22*b*. The percussive effect of these alternate contacts acts as an additional energy loss mechanism, but it is not detrimental to the primary means of damping, by sliding movement between the friction surfaces 48*a* and 48*b* and the angled faces 22*a* and 22*b*.

We claim:

1. A vibration damper for installation between a first blade of a gas turbine engine and a second blade of a gas turbine engine, the second blade being circumferentially adjacent to the first blade, the first blade having associated with it a first, planar face, the second blade having associated with it a second, planar face, the first face and the second face being radially convergent, the damper having associated with it a first, planar friction surface for contacting the first face and a second, planar friction surface for contacting the second face, the first friction surface and the second friction surface being radially convergent, the closest-spaced ends of the first friction surface and the second friction surface being spaced apart by a distance at least as great as the maximum circumferential gap between the radially outer ends of the first face and the second face, the angle subtended by the first friction surface and the second friction surface being smaller than the angle subtended by the first face and the second face; wherein the mass of the damper is disposed such that the centre of mass of said damper lies in a plane bisecting the angle subtended by said first friction surface and said second friction surface.

2. A damper according to claim 1, wherein said damper is substantially wedge-shaped in cross section.

3. A damper according to claim 1, wherein said closest-spaced ends of said first friction surface and said second friction surface are joined by a convex, curved surface.

4. A damper according to claim 1, wherein the difference between the angle subtended by said first friction surface and said second friction surface and the angle subtended by said first face and said second face is approximately 10°.

5. A damper according to claim 1, wherein the angle subtended by said first friction surface and said second friction surface is approximately 110°.

6. A damper according to claim 1, wherein the angle subtended by said first face and said second face is approximately 120°.

* * * * *